US007234989B2

(12) United States Patent
Maddocks et al.

(10) Patent No.: US 7,234,989 B2
(45) Date of Patent: Jun. 26, 2007

(54) METHOD AND APPARATUS FOR ATTACHING PLUSH TO AN ARTIFICIAL EYE

(75) Inventors: Richard Maddocks, Barrington, RI (US); Eduardo Rodriguez, Tiverton, RI (US)

(73) Assignee: Hasbro, Inc., Pawtucket, RI (US)

( * ) Notice: Subject to any disclaimer, the term of this patent is extended or adjusted under 35 U.S.C. 154(b) by 99 days.

(21) Appl. No.: 10/773,927

(22) Filed: Feb. 6, 2004

(65) Prior Publication Data

US 2004/0214507 A1 Oct. 28, 2004

Related U.S. Application Data

(63) Continuation-in-part of application No. 10/300,084, filed on Nov. 20, 2002, now Pat. No. 6,811,461.

(51) Int. Cl.
*A63H 3/38* (2006.01)

(52) U.S. Cl. ..... 446/392; 446/389; 446/343

(58) Field of Classification Search ..... 446/392, 446/393, 342–349, 372
See application file for complete search history.

(56) References Cited

U.S. PATENT DOCUMENTS 2,497,872 A 2/1950 Erpf
2,536,523 A * 1/1951 Wintriss ..... 446/349
2,653,328 A 9/1953 Anderson et al.
3,846,199 A 11/1974 Cappelli
4,233,776 A 11/1980 Suzuki
4,393,619 A * 7/1983 Murch ..... 446/392
4,409,754 A * 10/1983 Moreau ..... 446/392
4,477,500 A 10/1984 Powell
4,511,522 A 4/1985 Rinchart
4,601,673 A 7/1986 Nasca
4,629,442 A 12/1986 Samo (Continued)

FOREIGN PATENT DOCUMENTS

DE 4003484 A1 * 8/1991

(Continued)

OTHER PUBLICATIONS

"Fantasy Eyes Oval Pupil," Dydacomp, 1999 at Haidasupplies.com.

(Continued)

*Primary Examiner*—Eugene Kim
(74) *Attorney, Agent, or Firm*—Perry Hoffman

(57) ABSTRACT

An artificial eye for use in animated plush toys has a one-piece eyeball and lid that are integrally molded. The eye further includes a shaped member and a retaining post. A crossplate of the shaped member is preferably curved to correspond to the curvature of the eye, and is operative to animate a portion of plush contiguous to the eye. The portion of plush to be animated has an attached elongated flap which includes a forked free end wherein each branch of the forked end includes a hole. The elongated flap is inserted into the doll's body or head cavity, and each branch is tucked under the curved crossplate of the shaped member. The retaining post engages the holes near the ends of each branch, thereby fixedly retaining the flap to the eye. When the eye is rotated the plush portion also moves thereby simulating movement of an eyelid.

20 Claims, 10 Drawing Sheets

U.S. PATENT DOCUMENTS

| | | | | | |
|---|---|---|---|---|---|
| 4,637,159 | A | * | 1/1987 | Kulis | 446/392 |
| 4,642,209 | A | | 2/1987 | Powell | |
| 4,662,856 | A | * | 5/1987 | Getgey et al. | 446/280 |
| 4,705,488 | A | * | 11/1987 | Bohl et al. | 446/393 |
| 4,737,132 | A | * | 4/1988 | Shunsaku | 446/348 |
| 4,828,531 | A | * | 5/1989 | Kuhn | 446/392 |
| 4,842,566 | A | | 6/1989 | Nagao | |
| 4,875,888 | A | | 10/1989 | Harvey | |
| 5,037,344 | A | | 8/1991 | Secrist | |
| 5,540,612 | A | | 7/1996 | Mendez | |
| 5,782,669 | A | * | 7/1998 | Hornsby et al. | 446/342 |
| 6,099,379 | A | * | 8/2000 | Eppley | 446/392 |
| 6,500,045 | B1 | | 12/2002 | Secrist | |

FOREIGN PATENT DOCUMENTS

| | | | | |
|---|---|---|---|---|
| DE | 29805037 | U1 | * | 5/1998 |
| DE | 20202364 | U1 | * | 7/2002 |
| EP | 1224961 | A1 | * | 7/2002 |
| ES | 2120341 | A1 | * | 10/1998 |
| GB | 2045095 | A | * | 10/1980 |
| GB | 2182257 | A | * | 5/1987 |
| JP | 2002320782 | A | * | 11/2002 |
| JP | 2003117255 | A | * | 4/2003 |
| RU | 2164432 | C1 | * | 3/2001 |
| RU | 2179876 | C1 | * | 2/2002 |

OTHER PUBLICATIONS

Edinburgh Imports, 1998; German hand-blown Glasseyes with wire loops for securing.
Taxidermy Eyes by Dan Brandt, 1994-1997.
Glass Eyes, Van Dyke Supply Co., Inc., 2002.
Research Mannikins, Inc., 2001 Catalogue.

* cited by examiner

METHOD AND APPARATUS FOR ATTACHING PLUSH TO AN ARTIFICIAL EYE

CROSS-REFERENCE TO RELATED APPLICATION

This is a continuation-in-part of U.S. patent application Ser. No. 10/300,084 filed on Nov. 20, 2002 now U.S. Pat. No. 6,811,461, the entire disclosure of which is incorporated herein by reference.

FIELD OF INVENTION

This invention relates generally to artificial eyes, and more particularly to a method and apparatus for attaching plush to an artificial eye for use with animated dolls that replicate human beings, animals, and other creatures so that realistic movement of plush contiguous to the eye may be effected.

BACKGROUND OF THE INVENTION

Society has seen an evolution of technology in a wide variety of industries, including the toy industry. This evolution in technology is quite apparent in several sectors of the toy industry. For example, technological enhancements have made video games more realistic and lifelike than anyone could have imagined ten years ago. Technological enhancements have also affected other sectors of the toy industry in more subtle ways. For example, board games now come with video displays on a regular basis, baseballs can measure their own velocities when thrown, and dolls can now speak, walk, and even roller skate. Many of these product enhancements have been driven by customer demand. As technology continues to improve, customers want toys that have more capabilities or that are more realistic.

One example of customer driven evolutions in the industry is found in the toys embodied as creatures, animals, dolls and various other life forms real or imagined. Dolls, despite their simplicity, have long been among the most popular toys, especially among younger children. Dolls, however, are not immune to customer demands. As such, customers have continually demanded a more lifelike doll. Therefore, dolls have become more realistic as technologies that have applications in the doll industry have evolved. As alluded to earlier, dolls now have enhanced movement and speaking capabilities that tend to make the doll seem more realistic and lifelike.

One important influence technological advancements have on the doll industry is seen in the development of dolls' eyes, which have evolved quite dramatically. Some of the more recent developments in clear plastic doll eyes relate to hemispherical and semi-spherical shaped eyes. With regard to clear plastic eyes, many variations have developed for representing the pupil and the iris. Some conventional eyeballs have the pupil and iris painted onto a flat back surface of the hemisphere, while others use stickers or emblems instead of paint. However, these technologies cannot be immediately adapted to meet customer demands because of other constraints placed on the industry by customers. One of the most important constraints is cost. Therefore, even though technologies may exist to meet customer demands, those technologies cannot be applied to this industry until they have adapted in such a way as to be more cost effective.

Due to the cost constraints mentioned above, the development of the doll eye itself seems to have reached a plateau. Recent attempts to increase the realism of dolls' eyes have focused on adding additional structure around the eye such as eyelids and eyelashes. One example of an eye with eyelashes is shown in FIG. 4 of U.S. Pat. No. 4,629,442 to Samo for "Artificial Eye for Doll" issued Dec. 16, 1986. This patent is illustrative of the problems associated with separately added features, such as eyelids and eyelashes. As shown in the figure, the eyelashes are separately formed and attached to the eye through secondary operations. These secondary operations are generally expensive and labor intensive. Additionally, current processes, such as those illustrated in Samo, are relatively expensive because they require additional parts that need to manufactured, stored, and assembled. Other conventional eyes also have separately molded lids that either attach to the eye in a separate operation or that wrap around the eye. These eyes, like the eyes of Samo, are problematic because they increase the part count of the doll and the number of production operations, both of which are costly.

Furthermore, it would be desirable to provide an inexpensive, yet realistic eye for use with a life-like moving doll having a flexible or plush covering. One such life-like, animated, moving doll is shown in FIG. 3 of U.S. Pat. No. 6,544,094 to Maddocks et al. for "Toy With Skin Coupled to Moving Part" issued Apr. 8, 2003 to Applicants' Assignee. As shown, the doll's flexible covering includes integrally molded clips that are used to attach the covering to slots in the body parts (for example, the eyes) to produce realistic animation. While the disclosed clip and slot arrangement effects movement of a flexible elastomeric skin in response to movement of the movable part, the arrangement is disadvantageous for use with a plush covering since it would require attaching a plurality of clips to the plush interior by sewing, gluing, or the like which would increase product cost.

U.S. Pat. No. 4,662,856 to Getgey et al. for "Animated Toy" issued May 5, 1987 discloses an animated plush toy with facial features such as a nose and eyes. The facial features have pins that penetrate the plush cover and affix to a plate that is driven by a cam mechanism. The plate moves generally vertically thereby effecting expansion and collapse of the plush cover for creating the impression of a living, breathing animal. Although movement of the plush and features is accomplished, the toy's eyes and movement fall short of the life-like realism demanded by modern consumers.

One artificial eye that overcomes the problems and limitations of the prior art is U.S. patent application Ser. No. 10/300,084 for "Artificial Eye With Integrally Molded Eyelid" filed on Nov. 20, 2002 by Applicants' Assignee. The disclosed artificial eye is realistic and well suited for use with life-like creatures and dolls. To further accent its realism, the eye has a one-piece eyeball and lid that are integrally molded. Additionally, the integrally molded eye and lid reduces the part count of the eye assembly when compared to conventional two-piece eye/lid combinations, which lowers the cost of production by eliminating high cost, labor intensive secondary operations. As disclosed, the eye is highly adaptable for different uses, but is somewhat disadvantageous for use with dolls requiring realistic eye movement and coordinated movement of a covering (e.g., plush) contiguous to the eye for simulating, for example, opening and closing of eyelids.

In view of the foregoing, a need exists for a life-like, realistic, one-piece molded eye that is operative to coordinate realistic movement of a covering such as plush, contiguous to the eye.

SUMMARY OF THE INVENTION

An artificial eye suitable for use in animated plush toys such as dolls has a one-piece eyeball and lid that are integrally molded. The integrally molded eye further includes a plush-engaging member attachable at a portion of the eye and a retaining member integral with the eye. In one of the described embodiments, a crossplate member or shaped member is preferably curved to correspond with the curvature of the eye. In accordance with another embodiment, a generally T-shaped member of the eye is operative to animate a portion of facial plush contiguous to the eye, which may correspond to an eyebrow, upper eyelid, or the like. Advantageously, the plush cover may include one or more openings corresponding to a movable feature such as an eye. A portion of plush to be animated has an attached elongated flap, which includes a forked end wherein each branch of the forked end includes a hole. The elongated flap is attached to the opening for the movable feature and is inserted into the doll's body or head cavity, after which each branch is tucked under the curved crossplate of the T-shaped member. The flap has a preferred length substantially corresponding to the eye diameter, and is stretched over the interior (concave) side of the eye. The eye retaining post engages the holes near the ends of each branch, thereby fixedly retaining the flap to the eye under tension. Additionally, a portion of plush above the opening may be glued to the top of the shaped member to prevent the animated plush portion from gathering. When the eye is rotated downward by a mechanical or electromechanical means, the shaped member of the eye pulls the flap and attached plush outward thereby creating the movement of a closing eyelid. When the eye is rotated upward, the retaining post of the eye pulls the flap and attached plush inward thereby creating the movement of an opening eyelid. Advantageously, the described embodiments also ensure aesthetic consistency during mass production. No artistic judgment or experience is required when attaching the upper lid to the eyeball, as there would be, for example, if it was attached by adhesive with no positive location. The "crotch" of the flap with the forked ends provides a "foolproof" method of attachment.

Further advantages of the present invention, together with the organization and operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numeral indicate like parts.

DETAILED DESCRIPTION OF THE EMBODIMENTS

Figure 1:
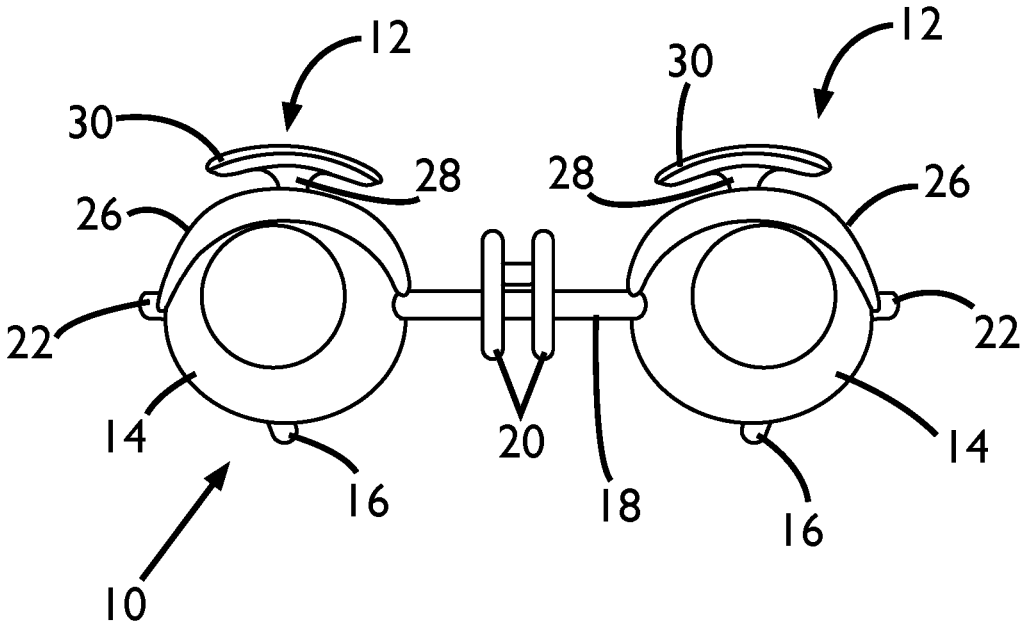
FIG. 1 is a front view of one embodiment of the present invention showing a pair of attached molded eyes with integral plush attachment members.
Figure 2:
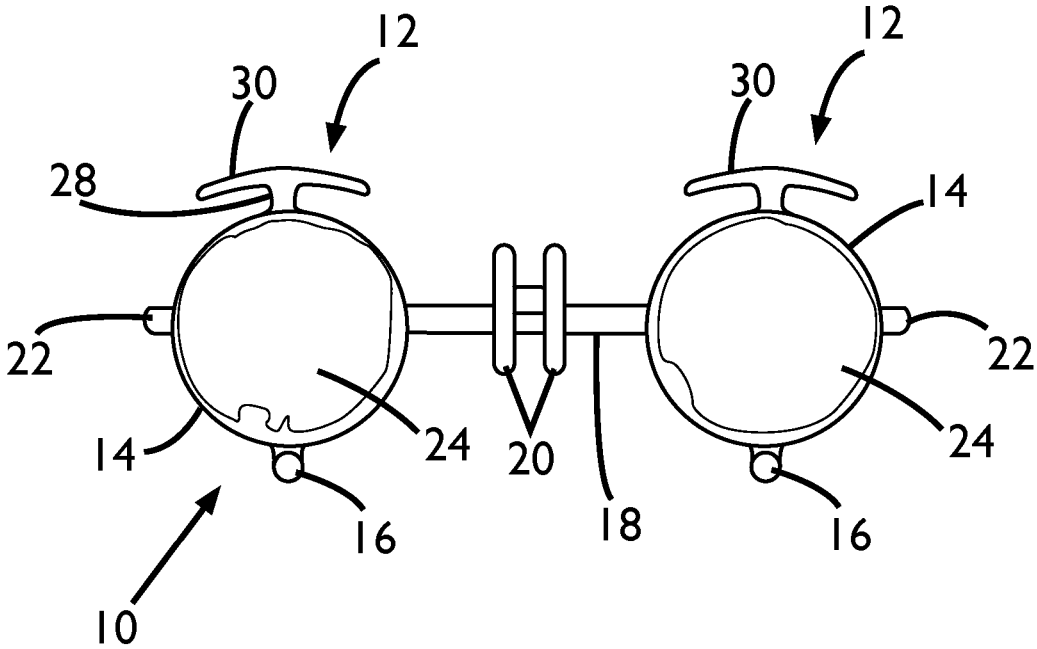
FIG. 2 is a rear view of the embodiment of FIG. 1 showing the concave portion of the eyes.

One embodiment of an artificial eye assembly 10 suitable for use in life-like plush dolls according to the present invention is illustrated in FIGS. 1-4. With reference first to FIGS. 1 and 2, one embodiment of the artificial eye assembly 10 includes an attached pair of spherical bowl-shaped members 14 each of which further includes a pupil and an iris which can either be painted or positioned within the spherical bowl-shaped member 14 to provide a realistic appearance.

As shown in FIGS. 1-4, the spherical bowl-shaped members 14 represent a pair of eyeballs. This spherical bowl-shaped member 14 is preferably made out of plastic, resin, or the like. However, one skilled in the art would understand that the spherical bowl-shaped member 14 could be made out of many other materials such as glass. Regardless of the type of material used, the described embodiments utilize low cost, transparent polymer, plastic or resin materials. These products are preferred because they produce high quality eyes, at a low cost, and in a sufficient volume. The described embodiments utilize a transparent material for the spherical bowl-shaped member 14 because various items, such as a pupil and an iris, can be painted or positioned within the spherical bowl-shaped member 14 or behind the spherical bowl-shaped member 14 to provide a realistic appearance. Furthermore, although, as discussed herein, the spherical bowl-shaped member 14 is transparent, it does not necessarily have to be transparent. Rather, the spherical bowl-shaped member 14 can be transparent, translucent, opaque, or any combination of part transparent, part translucent, or part opaque.

Since objects that replicate a pupil or iris can be placed in, on, or adjacent to the concave surface 24 of the spherical bowl-shaped member 14, the eye appears more realistic and lifelike because it replicates the arrangement of an actual eye. Furthermore, each spherical bowl-shaped member 14 may include a three-dimensional border member 26 partially surrounding and unitary with the spherical bowl-shaped member 14. The border member 26 may represent an eyelid, tear duct, ocular muscles, or the like to make the eye appear more realistic.

Figure 3:
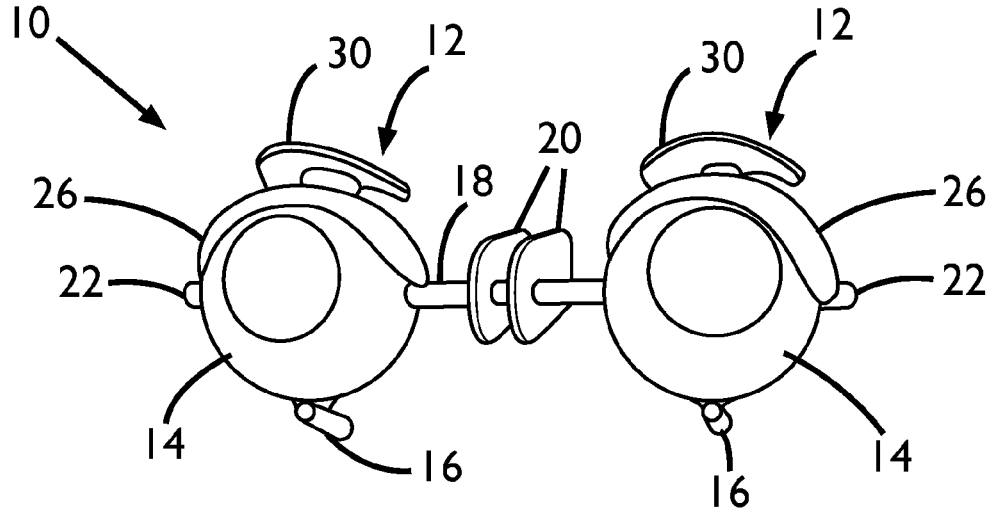
FIG. 3 is a front perspective view of the embodiment of FIG. 1.

As shown in FIGS. 1-3, each spherical bowl-shaped member 14 includes a generally T-shaped plush-engaging member 12, and a retaining post 16. Preferably, the T-shaped member 12 and retaining post 16 are integrally formed with the spherical bowl-shaped member 14 and border member 26 to achieve a low cost, artificial eye assembly 10. The T-shaped member 12 as shown in FIGS. 1 and 2 includes a stem 28 and a crossplate 30. The stem 28 attaches to and extends upward a short distance from the top of the spherical bowl-shaped member 14 and integral border member 26. The crossplate 30 is attached to the upper end of the stem 28 and is preferably curved radially to conform substantially to the curvature of the spherical bowl-shaped member 14.

Figure 4:
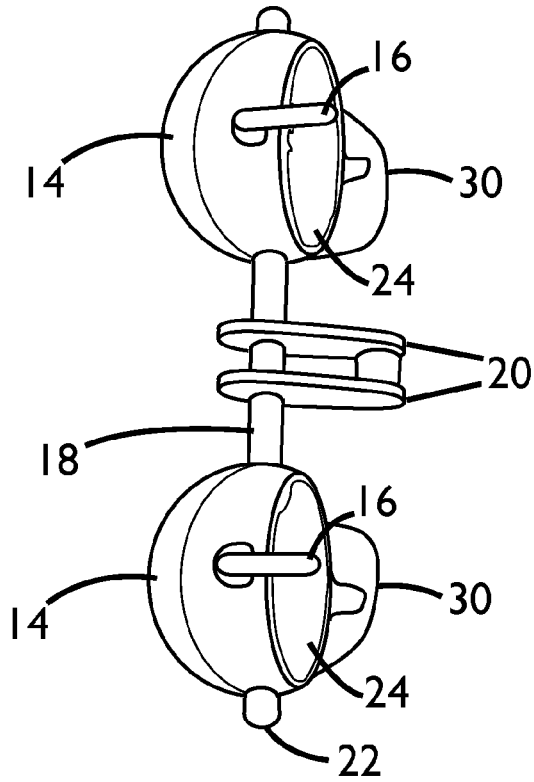
FIG. 4 is a bottom view of the embodiment of FIG. 1.

The crossplate 30 may curve and extend radially downward and forward from the stem 28 toward the iris and pupil. This downward curvature of the crossplate 30 assists in substantially obscuring the spherical bowl-shaped member 14 when the crossplate 30 is covered with plush and the eye assembly 10 is rotated downward. The retaining post 16 as shown in FIGS. 3 and 4 is formed onto a bottom portion of the spherical bowl-shaped member 14 and projects rearward the concave side 24. When the crossplate 30 is covered with plush as mentioned above, the retaining post 16 fixedly retains the portion of plush under tension which wraps around the crossplate 30 and is stretched across the concave side 24 of the spherical bowl-shaped member 14. In addition, a portion of plush may be glued or otherwise affixed to the top of the crossplate 30 to prevent the plush from bunching or gathering when the eye assembly 10 is rotated.

Figure 11:
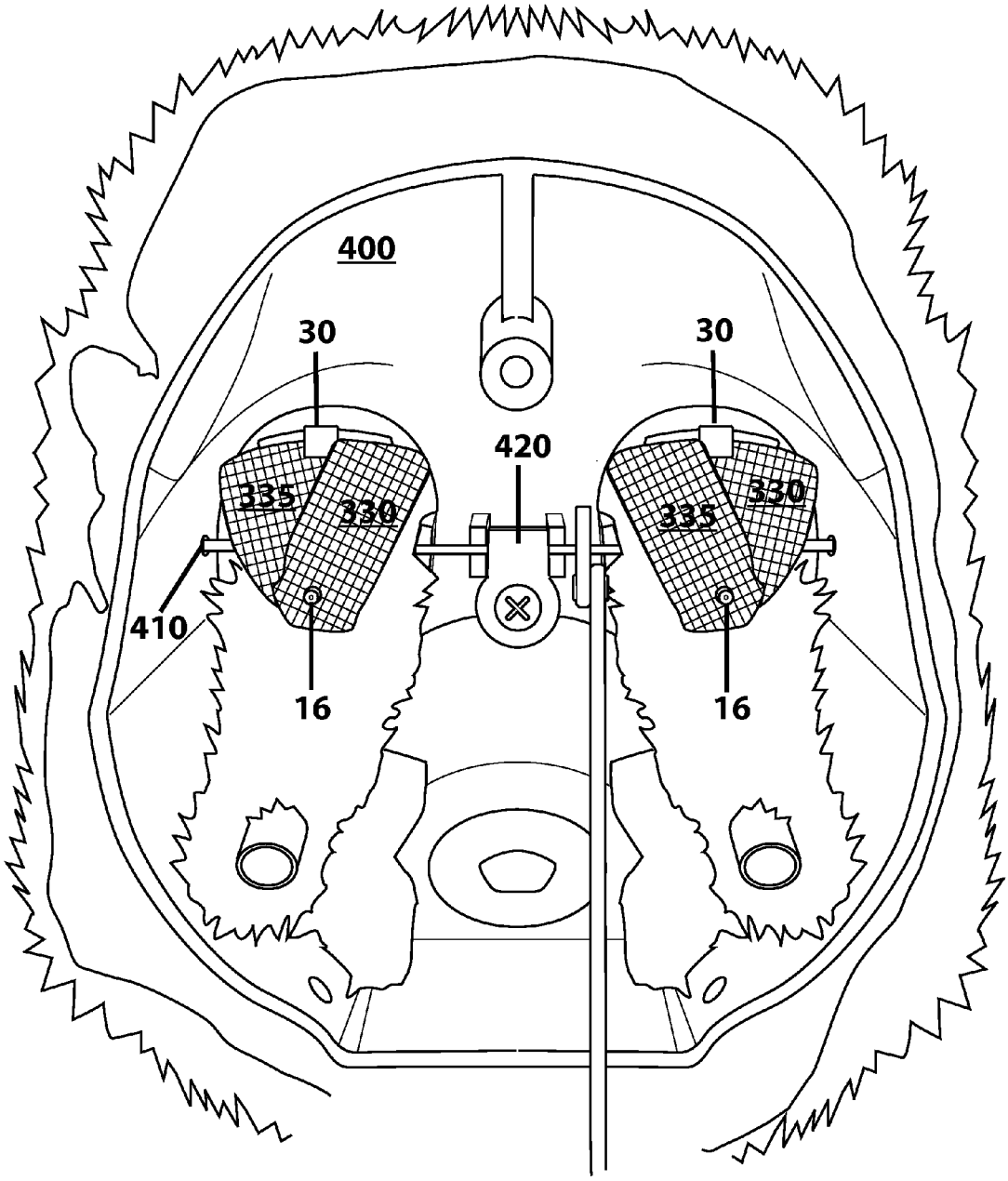
FIG. 11 is a view of FIG. 10 showing insertion of an embodiment of the present invention into an exemplary doll head cavity, and attachment of a portion of plush thereto.

Since most human and animal eyes move in a coordinated manner (i.e., both eyes move together in the same direction), it is desirable to animate each of the spherical bowl-shaped members 14 in a synchronized manner. To effect this desired coordinated eye movement, an attachment rod 18 having one or more integral crank 20 interconnects the spherical bowl-shaped members 14. The crank 20 is preferred to be generally centered on the attachment rod 18, and may attach to an actuating means operable to rotate the eye assembly 10. One such exemplary actuating means is shown in FIG. 11. The eye assembly 10 may also include pivot pins 22 which insert into corresponding holes, recesses, or the like within the doll's body or head cavity, and allow the eye assembly 10 to rotate up and down while remaining fixedly retained. As shown in FIG. 11, the pivot pins 22 may be retained by holes in the doll's head cavity, which additionally permit rotation of the eye assembly 10.

Figure 5:
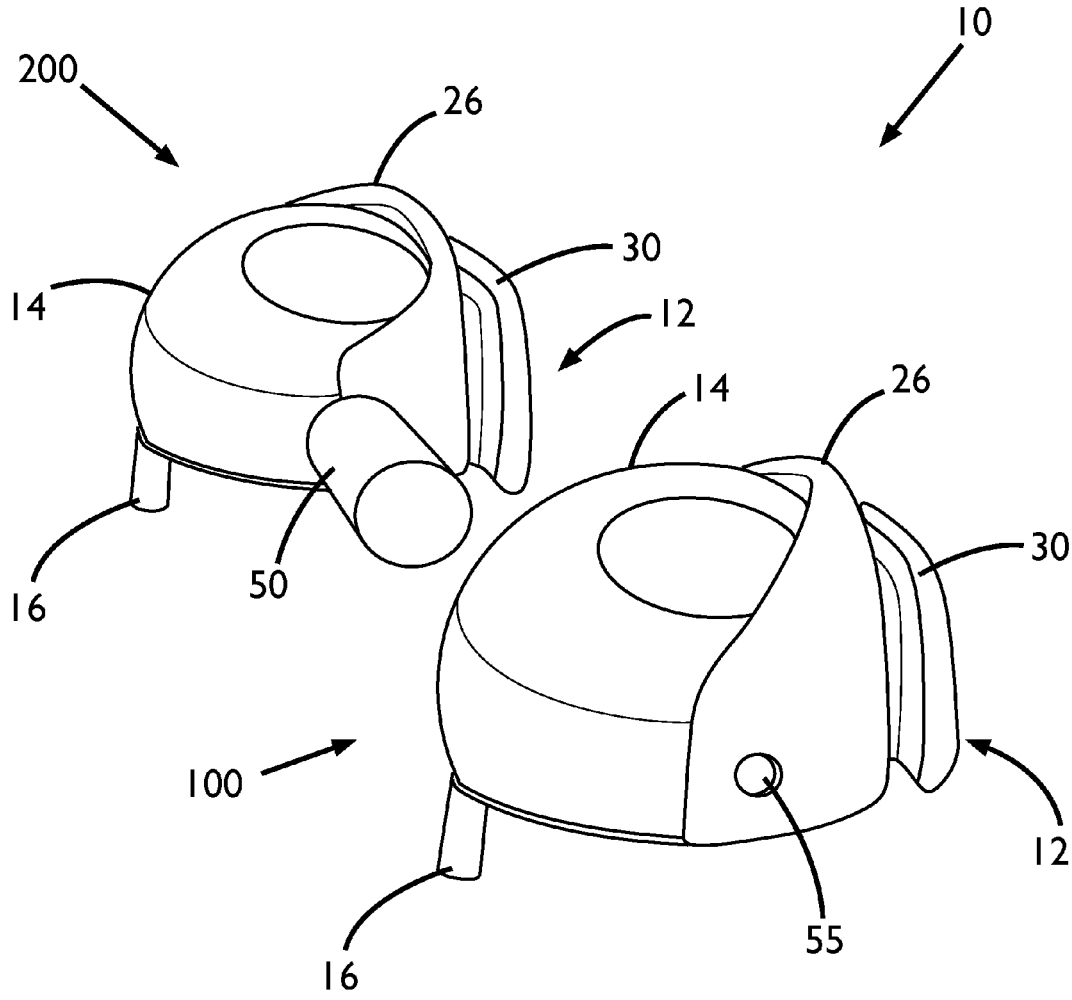
FIG. 5 is a perspective view of a second embodiment of the present invention wherein a pair of detached eyes is shown.
Figure 7:
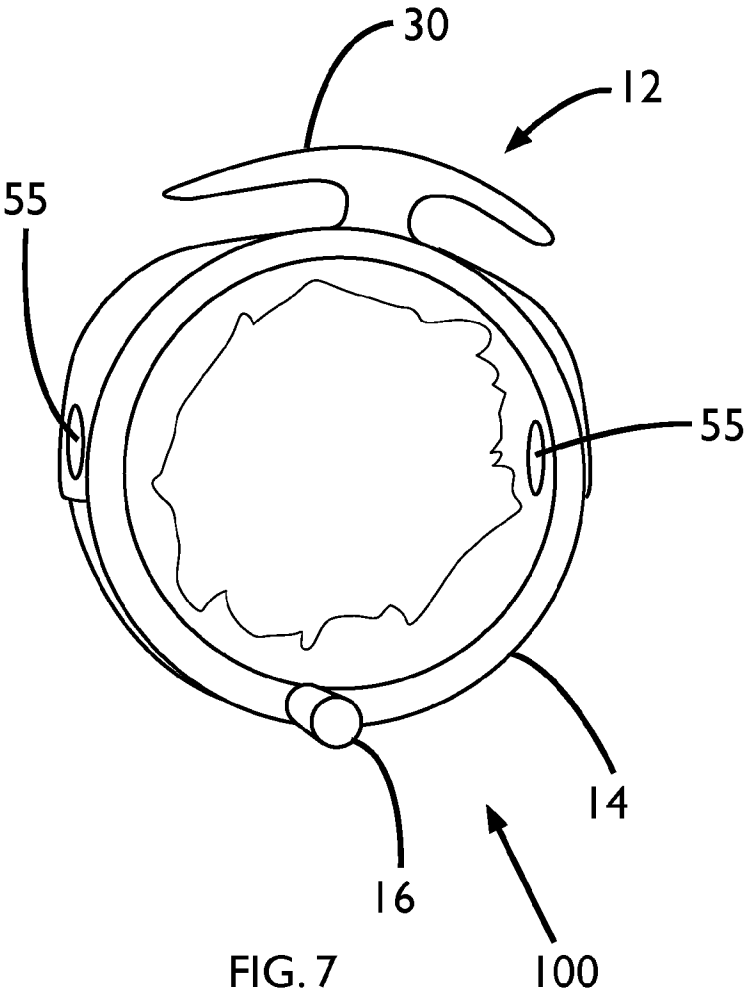
FIG. 7 is a rear view of the left eye of the embodiment FIG. 5.
Figure 6:
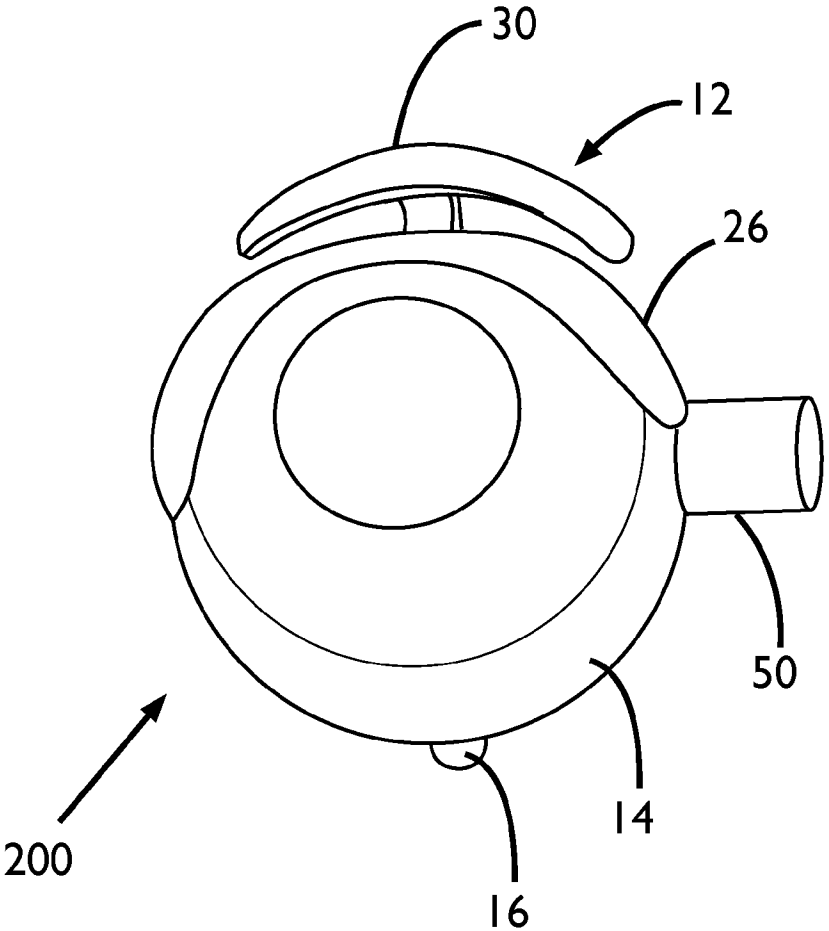
FIG. 6 is a front view of the right eye of the embodiment of FIG. 5.

A second embodiment of the artificial eye assembly 10 is shown in FIGS. 5-7. With particular reference to FIG. 5, the second embodiment of the eye assembly 10 includes a pair of disconnected spherical bowl-shaped members 14 which represent a left eyeball 100 and right eyeball 200 for a toy doll, animal, and the like. Although the left and right eyeballs are preferred to be mirror images of each other, they are not to be limited as such. By using disconnected eyeballs, a toy maker or designer may enjoy more artistic freedom in toy development by combining eyes with different characteristics such as iris color, pupil size, and the like.

As shown in FIGS. 5 and 6, the right eyeball 200 of the second embodiment includes a drive connector 50 for attaching the eyeball 200 to a driveshaft. When eyeball 200 is mounted to a driveshaft, the drive connector 50 preferably has an inner diameter that fixedly retains they eyeball 200 and prevents it from free rotation about the driveshaft. The driveshaft may have a cylindrical, square, or other shape, and the drive connector 50 preferably has a complimentary inner diameter shape to couple with the driveshaft. The outer diameter of the drive connector 50 may also be shaped to mate with a cam or other suitable driving means.

One eyeball of the disconnected pair of eyeballs, such as the left eyeball 100 shown in FIGS. 5 and 7 does not have a drive connector 50, but instead includes holes 55. The eyeball 100 may be mounted to the driveshaft by inserting the driveshaft through the holes 55. The holes 55 as shown in FIG. 5 are circular, but alternatively may be square or otherwise shaped to correspond with the driveshaft. It is obvious to one knowledgeable in the art that the holes 55 and driveshaft may be shaped so that the eyeball with holes may move independently from the other (driving) eyeball in an eccentric way, or not at all. Such independent eye movement is useful to simulate a wink, "lazy eye" or other unique eye conditions.

Figure 8:
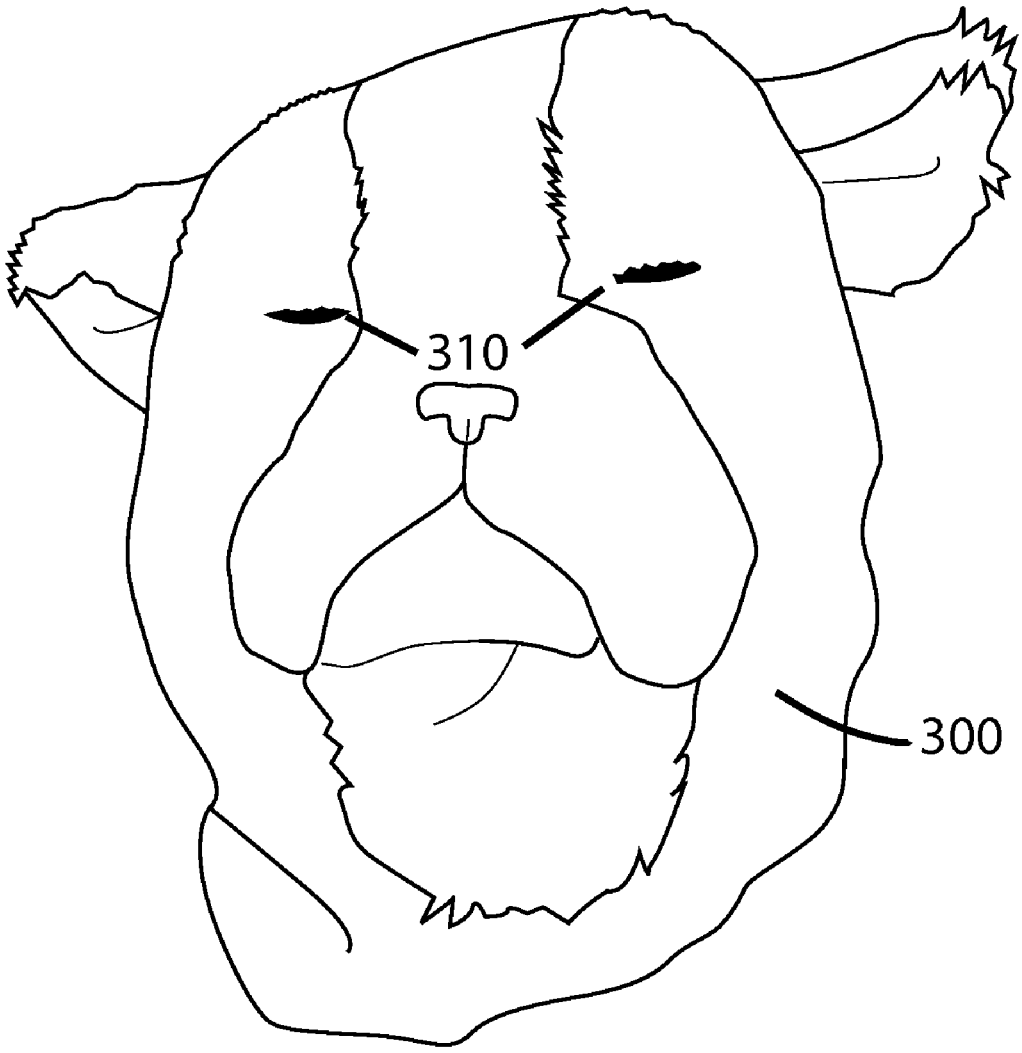
FIG. 8 an exemplary plush covering for a doll which has openings to display an embodiment of the present invention.

With reference now to FIGS. 8-12, a method of attaching plush to an artificial eye for a plush toy with animated eyes is described. In general, plush is a fabric with two sides, one side of which has soft extending fibers which may simulate hair or fur. FIG. 8 shows a plush covering 300 having the shape of a newborn pup. Although the plush covering 300 shown is the shape of a newborn pup, it alternatively may be of any suitable shape such as a baby doll, animal, creature, and the like to substantially correspond to a body. The toy body or portion thereof is inserted (see FIG. 10) into the plush covering and one or more openings 310 are arranged in the plush covering 300 to permit the display of a movable feature such as the toy's eyes.

Figure 9:
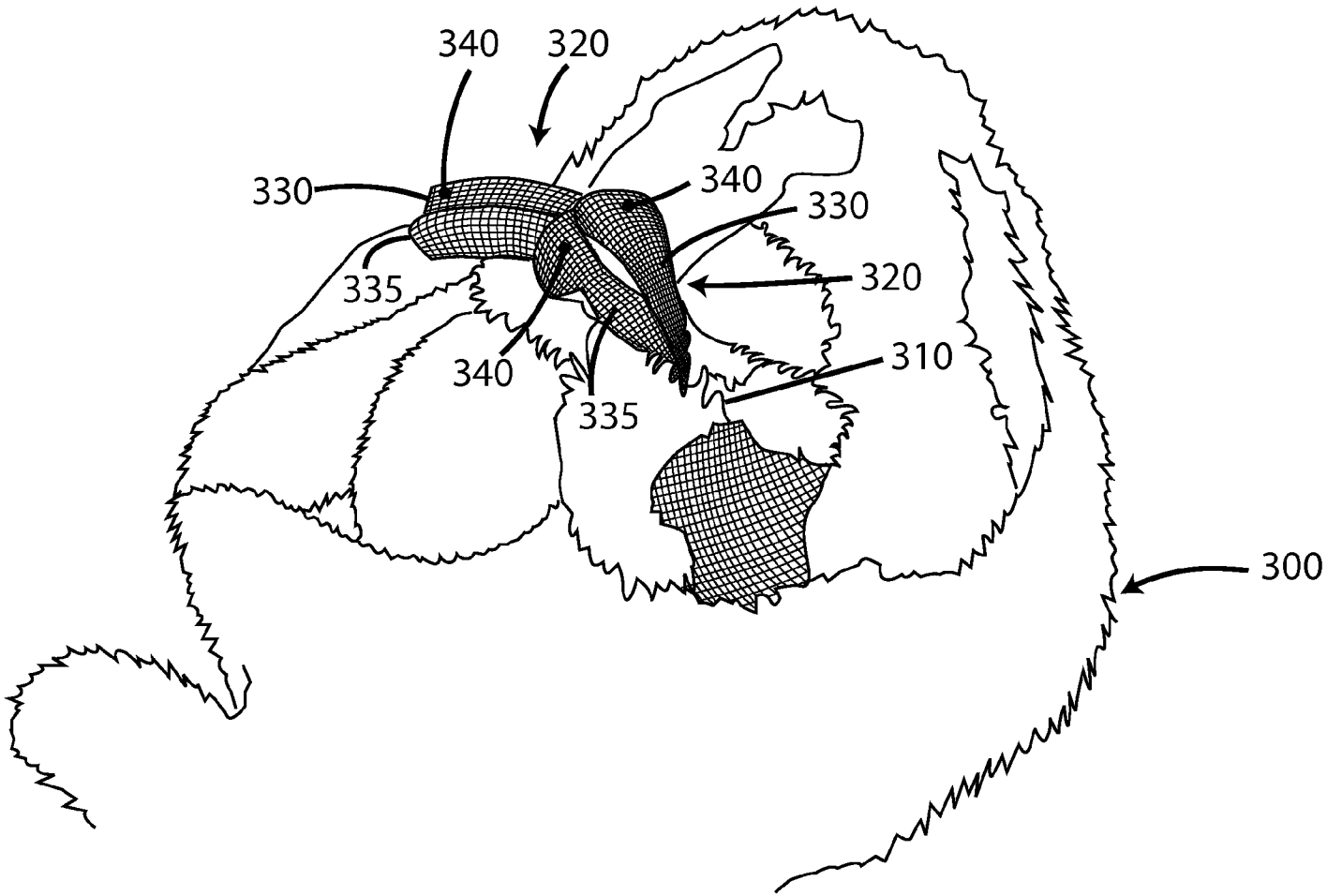
FIG. 9 is an inside-out view of the exemplary plush covering of FIG. 8.

As shown in FIG. 9, the plush covering 300 may be made of a number of plush pieces sewn or glued together. Openings 310 are preferably formed in seams of the plush pieces. Attached to a portion of the opening 310 is a flap 320. For an eye opening such as the one shown in FIGS. 8-11, the flap 320 preferably attaches to the upper portion of the opening 310 to effect animation of the upper eyelid. The flap 320 may be a piece of plush or other suitable material that is operative to attach to and engage the artificial eye assembly 10.

Figure 10:
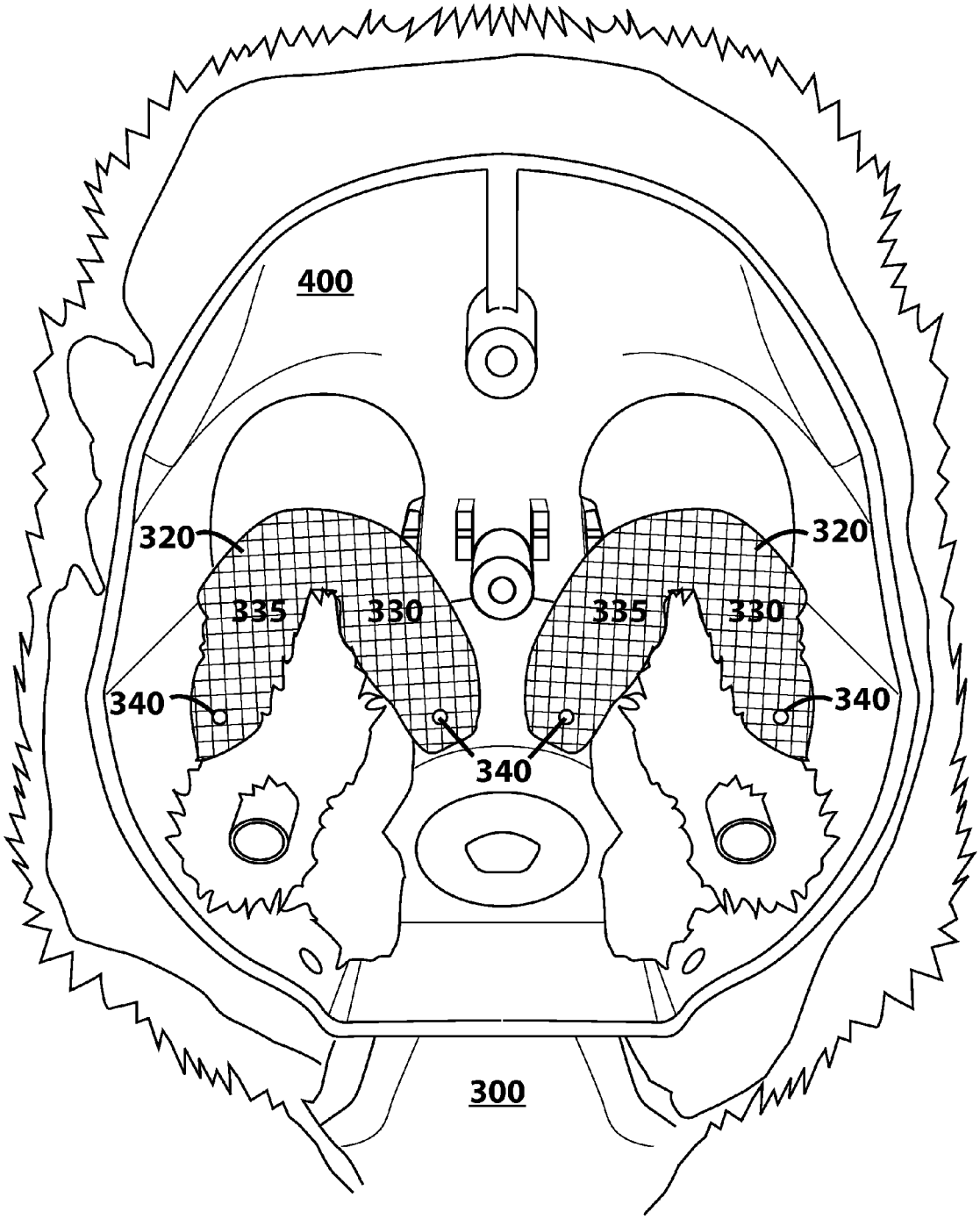
FIG. 10 is an inside-out view of the exemplary plush covering of FIG. 8 showing insertion of an exemplary doll head cavity.

As seen in FIG. 10, the flap 320 is preferably split lengthwise into a first branch 330 and a second branch 335, each branch having a free end with a hole 340. The flap 320 may have a generally U-shaped or V-shaped appearance, and the holes 340 may be created upon forcibly affixing each branch to the eye assembly 10. A toy head 400 is inserted into the plush covering 300 and aligned with the openings 310, and the flaps 320 are directed to project into the head 400. Additionally, other portions of the plush covering such as plush corresponding to a bottom eyelid may project into the head and may be affixed thereto by gluing, or insertion onto posts such as those shown in FIGS. 11 and 12.

Referring to FIG. 11, an artificial eye assembly 10 is disposed within the toy head 400. The pivot pins 22 are inserted into holes 410 or slots in the head, and the assembly 10 may further be retained by a retaining clip 420 which may be removably affixed to the head 400 by, for example, a screw. A driveshaft interconnects the two spherical bowl-shaped members 14 and further interfaces with a cam and drivelink. For each spherical bowl-shaped member 14 of the assembly 10, the flap 320 is inserted between the T-shaped member 12 and border member 26. The crook of the flap 320 (i.e., the point where the first and second branches fork) engages the stem 28 of T-shaped member 12, and the first branch 330 is stretched across the concave portion 24 of the spherical bowl-shaped member 14. The free end of the first branch 330 is affixed to the spherical bowl-shaped member 14 by sliding hole 340 onto retaining post 16. Similarly, the second branch 335 is inserted between the crossplate 30 and border member 26, and is stretched across the concave portion 24 of the spherical bowl-shaped member 14 partially overlapping the first branch 330. The second branch 335 is then affixed to the spherical bowl-shaped member 14 by inserting hole 340 onto the retaining post 16. As is obvious, each branch is preferred to be slightly longer than the diameter of the spherical bowl-shaped member 14. In this way, the flap 320 is tensioned between the forward edge of the crossplate 30, the stem 28, and retaining post 16.

Figure 12:
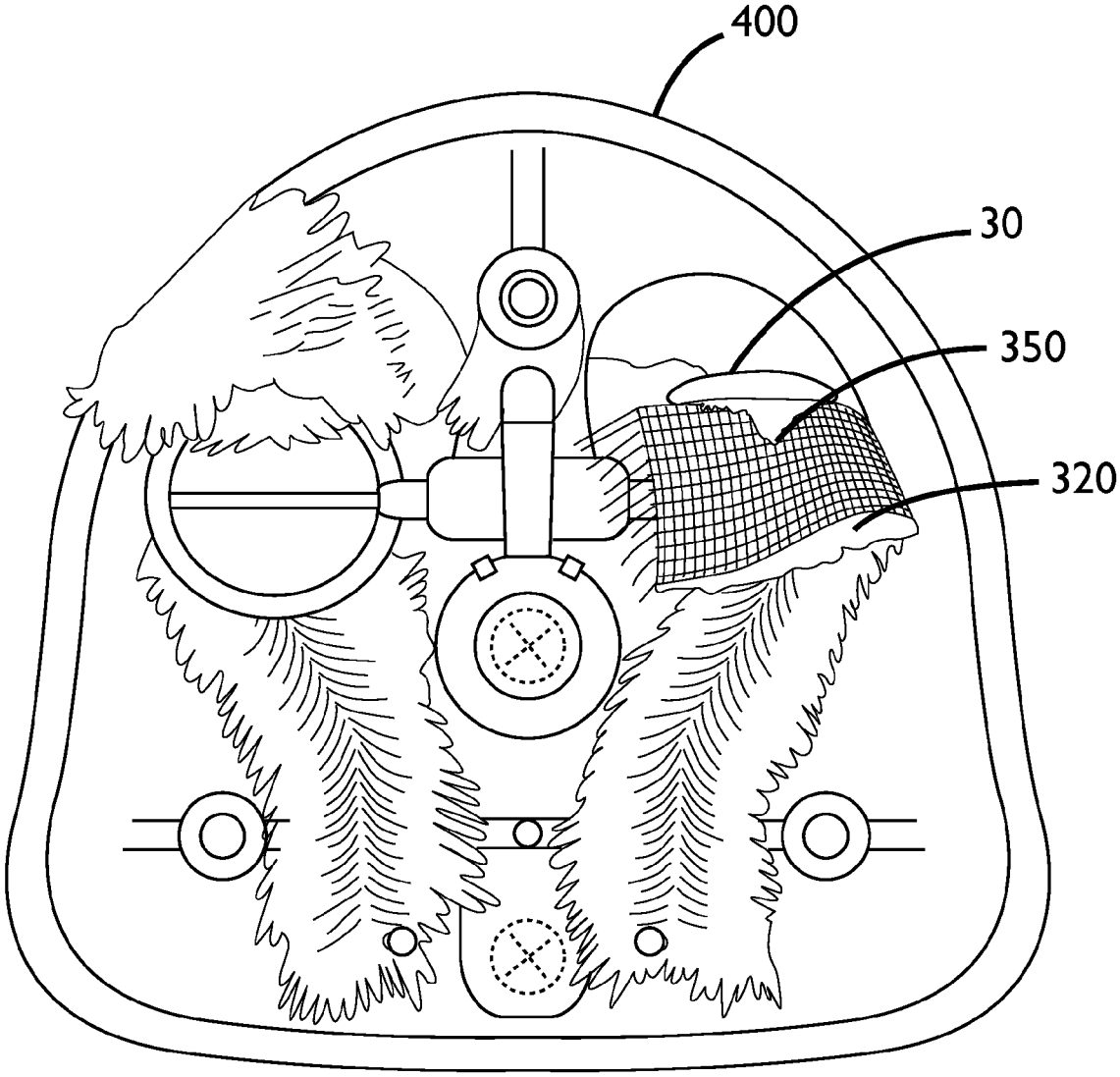
FIG. 12 is a view showing attachment of a portion of plush to an embodiment of the present invention by stitching the plush.

With reference now to FIG. 12, an alternative method of attaching a portion of plush to an artificial eye is shown. As shown, the plush flap 320 may include a slit 350 into which the T-shaped member 12 is inserted. Preferably, the slit 350 is large enough to accommodate the crossplate 30 and precludes the need to additionally cut or tear the plush. After the T-shaped member 12 is inserted through the slit 350, the slit 350 may be partially closed by stitching, sewing, stapling, or the like so that the stem 28 is snugly enveloped by the plush flap 320. In addition, if the plush flap 320 is split into two branches as described above and as shown in FIGS. 10 and 11, the branches 330 and 335 may be joined together by stitching, sewing, stapling or the like around the rear of the stem 28. This provides a convenient alternative to sliding hole 340 onto retaining post 16, as described above.

Having attached the flaps 320 to the eye assembly 10, realistic animation of the toy's eyelids may be effected as described hereafter. Ideally, the toy has a static (e.g., resting or sleeping) state where its eyes are rotated downward and eyelids are closed. From this static state, the user may activate the toy by pressing a button, or by triggering the toy which may be sound activated, light activated, or otherwise. Upon activating the toy, an eye animation means is operable to effect rotation of the eye assembly 10. As shown in FIG. 11, the eye animation means may include a cam pivotally affixed to a drivelink, but the animation means is not to be limited to such an arrangement. The drivelink and cam arrangement rotates the driveshaft which consequently rotates the eyes upward. In response to the upward rotation, the retaining posts 16 move arcuately forward and the flaps 320 are further tensioned. In response to the additional tension, the flaps 320 pull on the attached portion of plush so that the plush gathers or is redistributed above, near or within the opening 310 so that the-eye is unobstructed. To effect the animation of a closing eyelid, the drivelink and cam arrangement rotates the driveshaft to rotate the eyes downward. The forward edge of the crossplate 30 is driven arcuately forward and pulls the plush portion attached to the flap 320 arcuately forward and downward. The pulled plush portion conforming to the curved shape of the crossplate 30 provides the appearance of a closed eyelid in front of the eye.

Figure 13A:
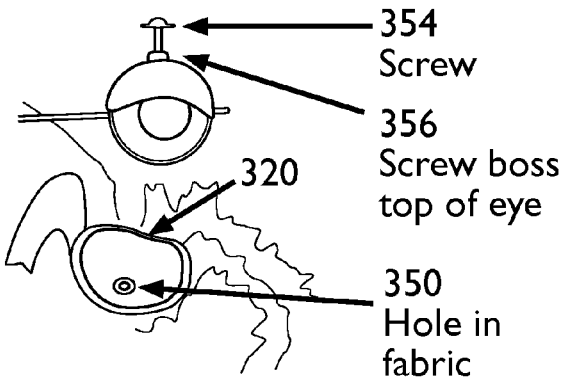
FIGS. 13A-D are views showing attachment of the plush via the fabric hole with a screw boss in the top of the eye.
Figure 13B:
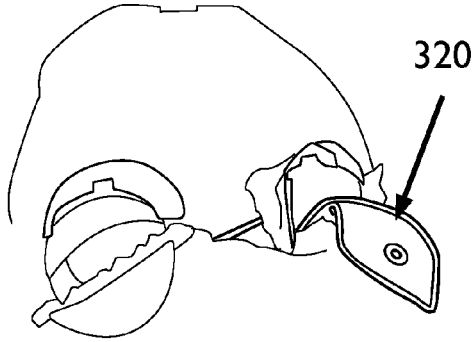
Figure 13C:
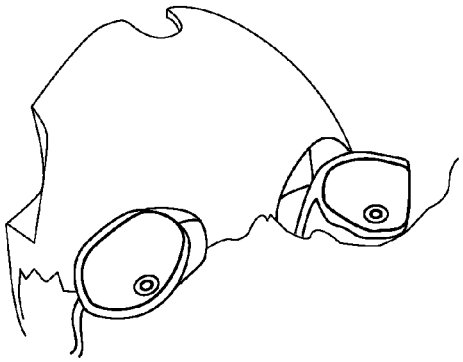
Figure 13D:
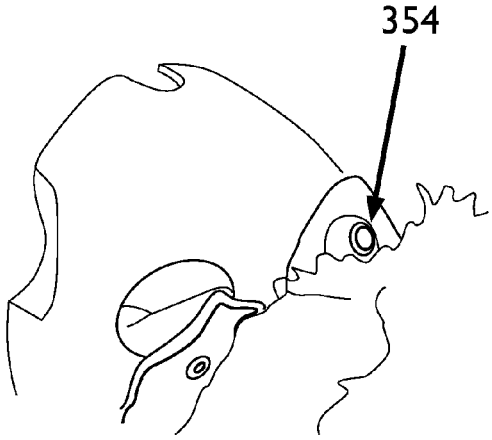

With reference to FIGS. 13A-D, alternate attachment of the plush via the fabric hole with a screw boss in the top of the eye attaching a portion of plush to an artificial eye is shown. As shown, the plush flap 320 may include a hole 352 via which a screw member 354 is inserted onto a boss 356. Preferably, the hole 352 precludes the need to additionally cut or tear the plush fabric. After the screw member 354 is inserted through the plush at hole 352, the hole 352 is secured on the stem 28 with the plush flap 320. FIG. 13C shows the holes aligned with the eyeballs tilted forward for access. This provides a further alternative to sliding hole 340 onto retaining post 16, as described above. To effect the animation of a closing eyelid, the drivelink and cam arrangement rotates the driveshaft to rotate the eyes downward. The forward edge of the crossplate 30 is driven arcuately forward and pulls the plush.

The embodiments described above and illustrated in the figures are presented by way of example only, and are not intended as a limitation upon the concepts and principals of the present invention. As such, it will be appreciated by one having ordinary skill in the art that ordinary changes in the elements and their configuration and arrangement are possible without departing from the spirit and scope of the present invention.

What is claimed is:

1. An artificial eye assembly for an animated plush toy operative to animate a portion of plush contiguous to the eye assembly comprising:

one or more transparent, spherical members having a convex surface and a concave surface;

at least one three-dimensional border member partially surrounding and unitary with said one or more transparent, spherical members; and a plush-engaging member integral with said one or more transparent, spherical members with the plush affixed thereto for movement of the plush with the eye assembly, wherein the plush-engaging member comprises a shaped member extending from the three-dimensional border member, and a retaining post, wherein the shaped member further comprises:

a stem attached to the three-dimensional border element; and a crossplate with a forward edge.

2. The artificial eye assembly of claim 1 wherein the crossplate is curved to substantially correspond with the radial curvature of the spherical member.

3. The artificial eye assembly of claim 1 wherein the shaped member further comprises a boss and screw for securing the plush engaging member.

4. The artificial eye assembly of claim 2, wherein the crossplate resembles an eyelid when covered with plush.

5. The artificial eye of claim 1 wherein said three-dimensional border member comprises one or more of an eyelid, tear duct, or ocular muscle.

6. An artificial eye for a toy wherein the toy comprises a body and a flexible body cover, the eye operative to animate a portion of body cover contiguous to the eye and comprising:

a transparent, spherical member having a convex surface and a concave surface;

at least one three-dimensional border member partially surrounding and unitary with the spherical member; and a cover-engaging member integral with the spherical member and radially spaced from said three-dimensional border member with the flexible body cover provided for being inserted between said three-dimensional border member and the cover-engaging member for being secured therein.

7. The artificial eye assembly of claim 6, wherein the spherical members are mirror images of each other.

8. The artificial eye assembly of claim 6 further comprising a second transparent, spherical member having a convex surface and a concave surface, and a rod interconnecting said one or more transparent, spherical members with the a second transparent, spherical member.

9. The artificial eye assembly of claim 8 wherein the rod is operable to effect coordinated movement of the spherical members.

10. The artificial eye assembly of claim 8 wherein the rod is operable to effect independent movement of the spherical members.

11. The artificial eye of claim 6 wherein a pupil and iris are painted in the concave surface of the spherical member.

12. The artificial eye of claim 6, wherein a pupil and iris are inserted into the concave surface of the spherical member.

13. The artificial eye of claim 6 wherein said three-dimensional border member comprises one or more of an eyelid, tear duct, or ocular muscle.

14. A method of attaching a plush covering of a toy to a movable artificial eye assembly to effect animation of the covering, wherein each eye of the assembly includes a retaining post and a plush engaging member having a stem with attached crossplate radially spaced from the eye, and the covering includes openings and a flap attached to a portion of each opening, wherein the flap is forked in two branches, each branch having a hole at its free end, the method comprising:

inserting a toy body into the plush covering;

aligning the body with the openings in the plush covering;

inserting the flaps into the body;

disposing the artificial eye assembly within the body;

for each eye of the assembly inserting the first and second branch of the flap between the crossplate and eye, each branch separated by the stem;

stretching the first branch across the back of the eye and placing the hole of the free end onto the retaining post; and stretching the second branch across the back of the eye, partially overlapping the first branch and placing the hole of the free end onto the retaining post.

15. An artificial eye assembly for an animated plush toy operative to animate a portion of plush contiguous to the eye assembly comprising:

one or more transparent, spherical members having a convex surface and a concave surface;

at least one three-dimensional border member partially surrounding and unitary with said one or more transparent, spherical members; and a plush-engaging member integral with said one or more transparent, spherical members receiving the portion of the plush contiguous to the eye assembly being inserted between said three-dimensional border member and the plush-engaging member extending the plush behind said one or more transparent, spherical members and affixed thereto for movement of the plush with the eye assembly, wherein said plush-engaging member is radially spaced atop said three-dimensional border member with the plush provided for being inserted between said three-dimensional border member and said plush-engaging member.

16. The artificial eye of claim 15 wherein the plush-engaging member further comprises:

a shaped member extending from the three-dimensional eyelid member; and a retaining post.

17. The artificial eye of claim 16 wherein the retaining post is diametrically opposite the shaped member.

18. The artificial eye of claim 15, wherein said three-dimensional border member comprises one or more of an eyelid, tear duct, or ocular muscle.

19. The artificial eye of claim 15 wherein a pupil and iris are painted in the concave surface of the spherical member.

20. The artificial eye of claim 15, wherein a pupil and iris are inserted into the concave surface of the spherical member.

* * * * *